US011031695B2

(12) United States Patent
Lin et al.

(10) Patent No.: US 11,031,695 B2
(45) Date of Patent: Jun. 8, 2021

(54) LOOP ANTENNA

(71) Applicant: MERRY ELECTRONICS (SHENZHEN) CO., LTD., Guangdong (CN)

(72) Inventors: Hsien-Chang Lin, Taichung (TW); Heng-Yi Liao, Taichung (TW); Shuo-Man Yuan, Taichung (TW); Tsu-Jung Wang, Taichung (TW)

(73) Assignee: MERRY ELECTRONICS (SHENZHEN) CO., LTD., Guangdong (CN)

( * ) Notice: Subject to any disclaimer, the term of this patent is extended or adjusted under 35 U.S.C. 154(b) by 0 days.

(21) Appl. No.: 16/827,707

(22) Filed: Mar. 24, 2020

(65) Prior Publication Data

US 2021/0104820 A1 Apr. 8, 2021

(30) Foreign Application Priority Data

Oct. 7, 2019 (TW) ..... 108136281

(51) Int. Cl.
*H01Q 1/38* (2006.01)
*H01Q 1/48* (2006.01)
*H01Q 7/00* (2006.01)

(52) U.S. Cl.
CPC ..... *H01Q 7/00* (2013.01); *H01Q 1/38* (2013.01); *H01Q 1/48* (2013.01)

(58) Field of Classification Search
None
See application file for complete search history.

(56) References Cited

U.S. PATENT DOCUMENTS 8,581,799 B2 * 11/2013 Choi ..... H01Q 5/335 343/845
8,648,763 B2 * 2/2014 Choi ..... H01Q 1/48 343/845
2006/0114159 A1 * 6/2006 Yoshikawa ..... H01Q 9/36 343/702

* cited by examiner

*Primary Examiner* — Anh Q Tran
(74) *Attorney, Agent, or Firm* — CKC & Partners Co., LLC

(57) ABSTRACT

A loop antenna includes a printed circuit board (PCB), a first antenna structure and a second antenna structure. The PCB includes a first surface and a second surface relative to the first surface, and the PCB includes a clear region and a ground region, wherein the clear region is adjacent to the ground region. The first antenna structure is disposed in the clear region at the first surface. The first antenna structure includes a feed structure and a first ground end. The feed structure is coupled to a power feed end which is disposed in the ground region. The first ground end is coupled to the ground region. The second antenna structure is disposed relative to the first antenna structure at the second surface. The second antenna structure includes a second ground end. The second ground end is coupled to the ground region.

11 Claims, 5 Drawing Sheets

LOOP ANTENNA

CROSS-REFERENCE TO RELATED APPLICATION

This application claims priority to Taiwan Application Serial Number 108136281, filed Oct. 7, 2019, all of which are herein incorporated by reference.

BACKGROUND

Field of Invention

The present invention relates to a wireless communication component, which is particularly a loop antenna.

Description of Related Art

In order to reach the requirement of miniaturizing communication equipment, the design of the wireless communication structure is limited. For instance, for small-sized earphone, a plenty of antenna structures are included for implementation of Bluetooth function. However, when the antennas are limited in a small space, poor isolation may lead to decreased quality and performance of wireless signal transmission.

SUMMARY

A loop antenna is provided by the present disclosure, including a printed circuit board, a first antenna structure, and a second antenna structure. The printed circuit board includes a first surface and a second surface relative to the first surface, and the printed circuit board includes a clear region and a ground region, wherein the clear region is adjacent to the ground region. The first antenna structure is disposed in the clear region and is disposed at the first surface. The first antenna structure includes a feed structure and a first ground end. The feed structure is coupled to a power feed end disposed in the ground region. The first ground end is coupled to the ground region. The second antenna structure is disposed relative to the first antenna structure and is disposed at the second surface. The second antenna structure includes a second ground end. The second ground end is coupled to the ground region.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
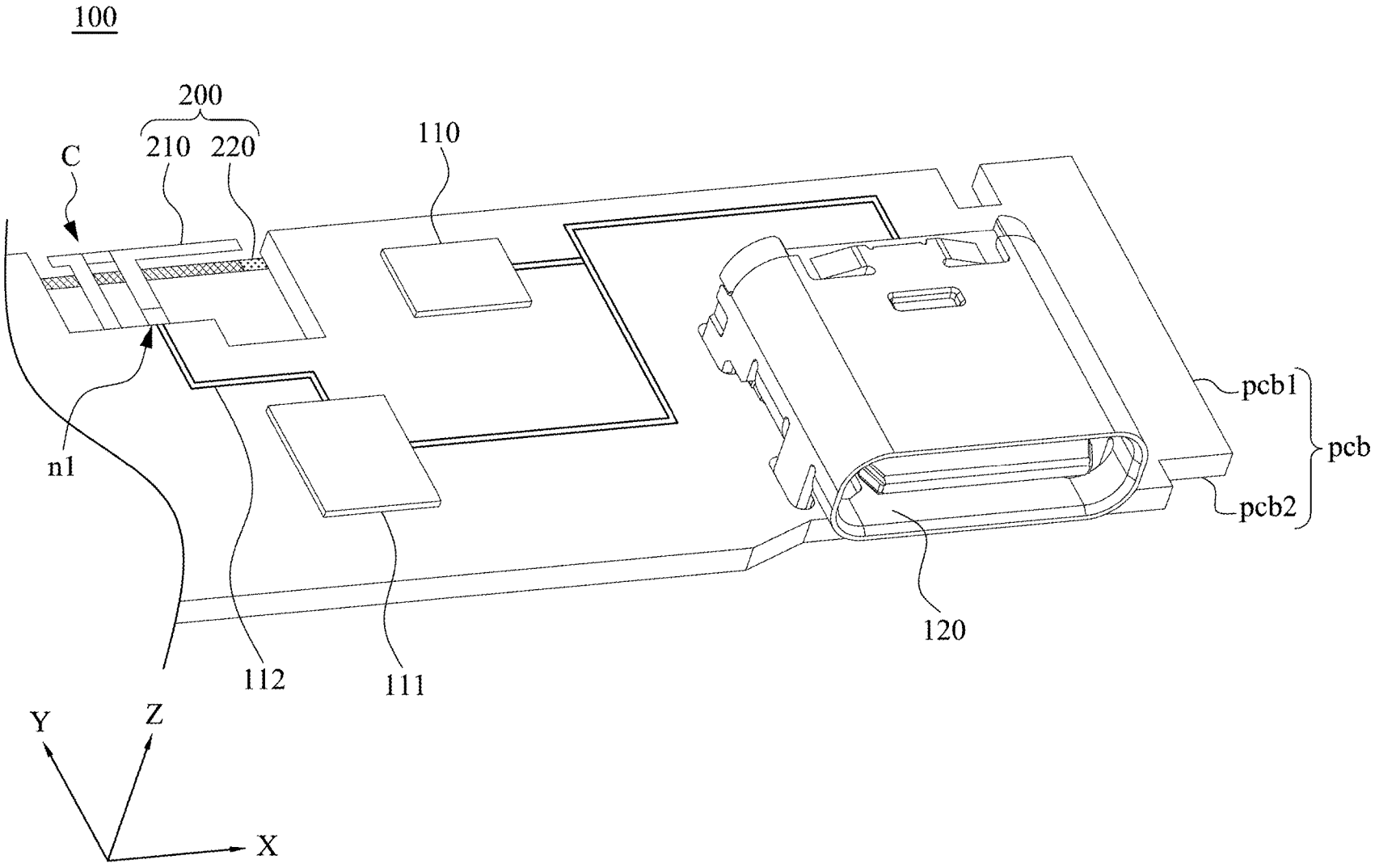
FIG. 1 is a structure schematic diagram of a part of electronic device, in accordance with one embodiment of the present disclosure.

Reference will now be made in detail to embodiments of the present disclosure, examples of which are described herein and illustrated in the accompanying drawings. While the disclosure will be described in conjunction with embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. It is noted that, in accordance with the standard practice in the industry, the drawings are only used for understanding and are not drawn to scale. Hence, the drawings are not meant to limit the actual embodiments of the present disclosure. In fact, the dimensions of the various features may be arbitrarily increased or reduced for clarity of discussion. Wherever possible, the same reference numbers are used in the drawings and the description to refer to the same or like parts for better understanding.

In the following description and in the claims, the terms "include" and "comprise" are used in an open-ended fashion, and thus should be interpreted to mean "include, but not limited to." As used herein, the term "and/or" includes any and all combinations of one or more of the associated listed items.

In this document, the term "coupled" may also be termed "electrically coupled," and the term "connected" may be termed "electrically connected." "Coupled" and "connected" may also be used to indicate that two or more elements cooperate or interact with each other. Besides, although the terms "first," "second," etc., may be used herein to describe various elements, these terms are used to distinguish one element from another. Unless the context indicates otherwise clearly, these terms does not specifically refer to or imply order or sequence, nor does they intend to limit the present invention.

In this document, the term "about", "approximately", etc., may be described as a constant or an average within 20%, or preferably within 10%, or more preferably within 5%. In this document, if the numerical value is described as an approximation, it may be inferred to be terms like "about", "approximately", etc.

An electronic device includes components for implementation of wireless communication functions. Some examples of the electronic device include a computer, a cell phone, and a wireless phone, etc., wherein the wireless communication functions include Wi-Fi and Bluetooth, etc., configured to transmit signals (also referred as data) through the wireless communication function components to another electronic device.

Generally, the Bluetooth function component is implemented by an antenna structure, wherein a working frequency bandwidth of Bluetooth is about at 2.4~2.485 GHz. For a conventional antenna, in order to implement the antenna with the working frequency bandwidth mentioned above, by an example of 2.4 GHz, the length of the antenna structure is required to be larger than one quarter of wavelength of the working frequency bandwidth (i.e., about 20~25 mm). As such, the conventional antenna may not be arranged in a miniaturized electronic device. Therefore, a loop antenna is provided by the embodiments of the present disclosure to overcome these deficiencies mentioned above.

For simplicity, only a part of structure of an electronic device 100 is illustrated in FIG. 1, which is a structure schematic diagram in accordance with one embodiment of the present disclosure.

In the embodiments of the present disclosure, the electronic device 100 is an example of Bluetooth earphone, wherein the wireless communication function is Bluetooth for exemplary description, and other examples of the electronic device 100 and the wireless communication functions are also included in the embodiments of the present disclosure.

As illustrated in FIG. 1, the electronic device 100 includes a printed circuit board pcb, a circuit component 110, a connection port 120, and a loop antenna 200. The circuit component 110, the connection port 120, and the loop antenna 200 are disposed in the printed circuit board pcb, wherein the circuit component 110 is coupled to the connection port 120 and the loop antenna 200.

The connection port 120 is configured to couple to transmission lines (not shown), for transmitting signals (also referred as data) between the transmission lines and the circuit component 110. In some embodiments, the connection port 120 is an universal serial bus (USB). In some embodiments, the connection port 120 is a high definition multimedia interface (HDMI). In some embodiments, the connection port 120 is an audio interface with 3.5 mm or other interface which is configured to transmit the signals, and the connection port 120 is not limited to the embodiments of the present disclosure.

The circuit component 110 includes an integrated circuit (IC) and metal transmission lines, etc., wherein the IC further includes a loop antenna IC 111, which is configured to control the loop antenna 200. The loop antenna IC 111 is coupled through a metal transmission line 112 to the loop antenna 200, and where they are coupled to each other is a power feed end n1.

The printed circuit board pcb is a flat structure and has a first surface pcb1 and a second surface pcb2 relative to the first surface pcb 1, wherein the first surface pcb1 and the second surface pcb2 are in parallel with respect to a third direction (i.e., Z-direction). In addition, upon a platform with respect to a first direction (i.e., X-direction) and a second direction (i.e., Y-direction), a notch C is formed from the printed circuit board pcb toward interior of thereof, where the loop antenna 200 is disposed.

Since the printed circuit board pcb is an insulator, the printed circuit board pcb is indicated as a ground relative to the loop antenna 200, and the notch C is indicated as a radiative zone for coupling the signals.

The loop antenna 200 includes a first antenna structure 210 and a second antenna structure 220 (shown as full-filled meshes), and the first antenna structure 210 and the second antenna structure 220 are disposed at different surfaces of the printed circuit board pcb (i.e., the first surface pcb1 and the second surface pcb2), respectively.

The loop antenna 200 is driven by the loop antenna IC 111, wherein the loop antenna IC 111 transmits the signals (also referred as data and power, etc.) through the metal transmission line 112, and feeds the signals in the first antenna structure 210 through the power feed end n1. When the signals are fed in the first antenna structure 210, the signals are fed in through the feed point of the first antenna structure 210 (e.g., a feed point 212 shown in FIG. 2), and the signals are coupled to the second antenna structure 220. Subsequently, the signals are coupled to another wireless communication component (not shown) by the second antenna structure 220, in order to implement the wireless communication function.

The signal of the loop antenna 200 provided in the present disclosure refers to an electromagnetic wave. To understand in another way, coupling signal in the loop antenna 200 refers to coupling energy, wherein an operation of the coupling does not require physically contact between solid structures.

Figure 2A:
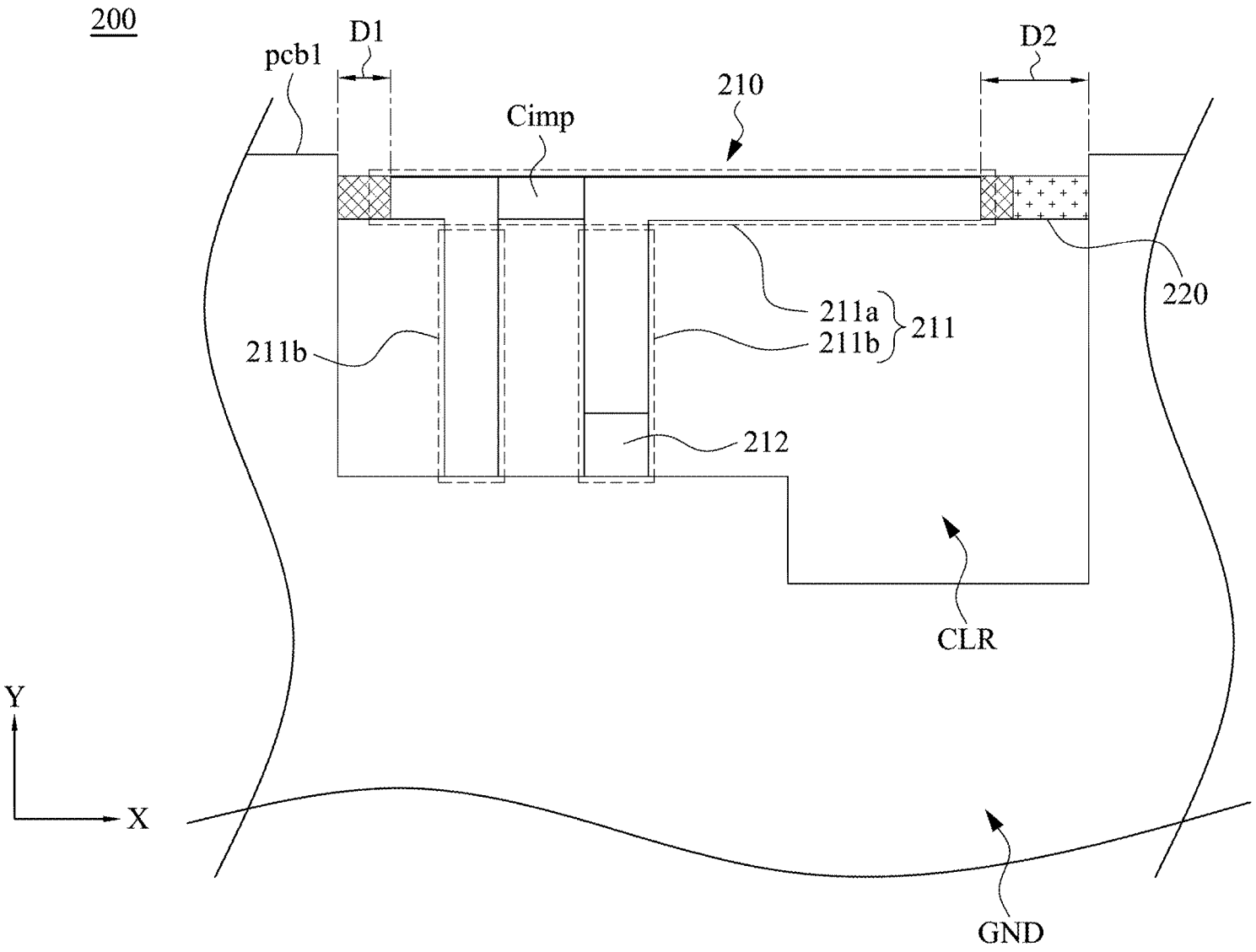
FIG. 2A is a structure schematic diagram of a first surface of a printed circuit board of a loop antenna, in accordance with FIG. 1.
Figure 2B:
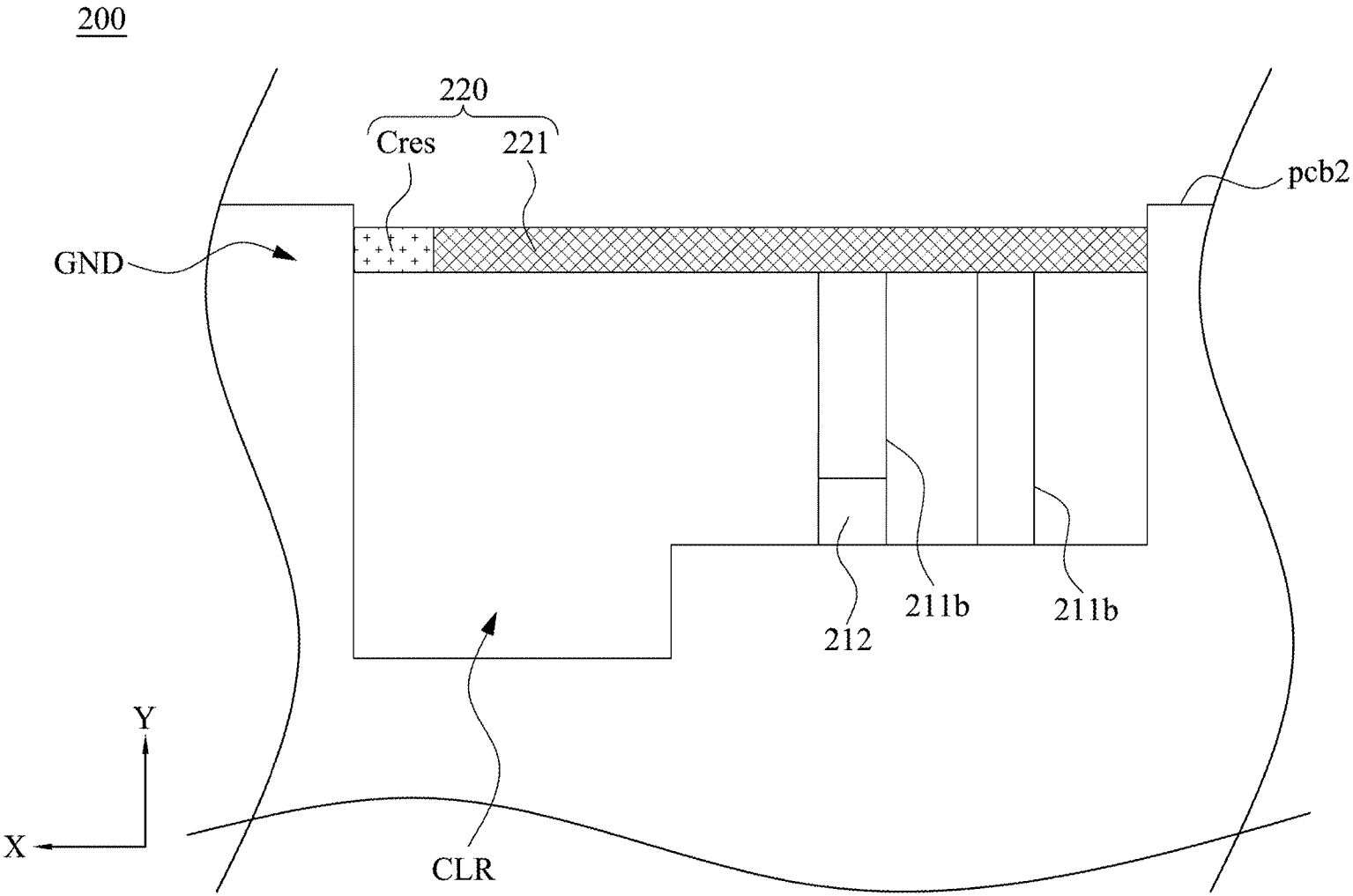
FIG. 2B is a structure schematic diagram of a second surface of a printed circuit board of a loop antenna, in accordance with FIG. 1.

Reference is now made to FIGS. 2A and 2B, described the structure of the loop antenna 200 in FIG. 1 in detail, and illustrated the first antenna structure 210 and the second antenna structure 220 respectively. With reference to FIG. 1, part of the same elements in FIGS. 2A and 2B are not numbered or illustrated repeatedly, and only the structure of the loop antenna 200 is illustrated in FIGS. 2A and 2B.

FIG. 2A is a structure schematic diagram of the first surface pcb1 of printed circuit board pcb of the loop antenna 200 in a top view, in accordance with part of structure in FIG. 1, wherein the platform shown in FIG. 2A is indicated as a X-Y plane.

As illustrated in FIG. 2A, due to the notch C, the printed circuit board pcb forms a clear region CLR and a ground region GND. The ground region GND is an isolated structure, and belongs to a region of the printed circuit board pcb without arranging the metal transmission line 112 and the circuit component 110. The clear region CLR is a region without solid structures, for taking air as a transmission medium of the loop antenna 200.

The design of clear region CLR, for example, including three-dimensional (3D) shape and space, is associated with both of the loop antenna 200 structure and other circuit component 110 of the printed circuit board pcb. The bigger the size of the clear region CLR is, the bigger space for coupling signal in the loop antenna 200 is, and thus the better communication performance provided thereof is. Simultaneously, the bigger clear region CLR may suppress the design space for other circuit component 110. Therefore, the space of the clear region CLR with respect to the printed circuit board pcb is an optimized configuration, in accordance with the miniaturized electronic device 100 of some embodiments of the present disclosure.

In some embodiments, the clear region CLR is an irregular 3D space. In some embodiments, the clear region CLR is in as shape of a box. The 3D shape of the clear region CLR is within the scope of the embodiments of the present disclosure. In some embodiments of the present disclosure, the clear region CLR is indicated as the irregular 3D space as illustration, for example, the clear region CLR shown in FIGS. 2A-2B, for reaching good signal coupling performance with limited space.

As illustrated in FIG. 2A, the first antenna structure 210 is disposed inside the clear region CLR, and the first antenna structure 210 is disposed on the first surface pcb1. The first antenna structure 210 is shaped as a metal sheet integrally formed, which is indicated as a feed metal sheet 211 herein, wherein the feed metal sheet 211 includes a first structure 211*a* and a second structure 211*b*, and both of the first structure 211*a* and the second structure 211*b* are shaped as long strap sheet.

The first structure 211*a* extends along a long side of the printed circuit board pcb (i.e., extending to the X-direction), and is separated from two sides of the printed circuit board pcb by a first interval D1 and a second interval D2, respectively.

With continued discussion above, since two ends of the first structure 211*a* are separated from the printed circuit board pcb by the first interval D1 and the second interval D2, respectively, the first structure 211*a* does not physically contact with the printed circuit board pcb. To understand in another way, the first structure 211*a* is not grounded. Therefore, the signal is coupled completely through the first structure 211*a* to the second antenna structure 220 when the first structure 211*a* couples the feed signal, in order to enhance the signal coupling performance.

In some embodiments, the first interval D1 is equal to the second interval D2. In some embodiments, the first interval D1 is smaller than the second interval D2. In practical, the lengths of the first interval D1 and the second interval D2 are designed based on the sizes of the first structure 211*a* and the clear region CLR. For instance, with respect to the X-Y plane, when the size of the clear region CLR is about 4 mm*7 mm (i.e., 4*7 $mm^2$), the first interval D1 is about in a range of 0.4 to 0.6 mm, and the second interval D2 is about in a range of 0.9 to 1.1 mm. When both of an area of the clear region CLR and a length of the first structure 211*a* (which is the length with respect to the X-direction) shrink, both of the first interval D1 and the second interval D2 shrink correspondingly.

The feed metal sheet 211 includes two second structures 211*b*, and each of the second structures 211*b* extends from the first structure 211*a*. The second structures 211*b* extend along a short side of the printed circuit board pcb (i.e., extending to the negative Y-direction). The second structures 211*b* extend to the printed circuit board pcb and couple to the printed circuit board pcb. Namely, one end of the second structures 211*b* contact with the printed circuit board pcb physically.

In addition, the second structures 211*b* do not extend from a center of the length (with respect to the X-direction) of the first structure 211*a*. Alternatively stated, the second structures 211*b* extend from a specific spot (not shown) of the first structure 211*a* toward the negative Y-direction, and the specific spot mentioned above does not locate at a center location of the first structure 211*a* with respect to the X-direction. Therefore, with respect to the X-direction or the Y-direction, the whole first antenna structure 210 is an asymmetric structure.

With continued discussion above, the second structures 211*b* are parallel to each other with respect to the Y-direction, and each of the second structures 211*b* has the same length (with respect to the Y-direction). One of the second structures 211*b* couples to the power feed end n1, and where the second structures 211*b* couple to the power feed end n1 is indicated as the feed point 212, for receiving the signal feed from the power feed end n1. The other one of the second structures 211*b* is coupled to the ground region GND of the printed circuit board pcb, and where the second structures 211*b* coupled to the ground region GND is indicated as a first ground end (not shown), for grounding the signal.

In some embodiments, the length of the second structures 211*b* (with respect to the Y-direction) is smaller than the length of the first structure 211*a* (with respect to the X-direction).

The first antenna structure 210 further includes a matching capacitor Cimp. The matching capacitor Cimp is disposed on the first structure 211*a*, and is disposed at middle between where two of the second structures 211*b* connect to and extend from the first structure 211*a*, respectively. The matching capacitor Cimp couples to the first structure 211*a* and the second structures 211*b*.

In some embodiments, the length of the matching capacitor Cimp with respect to the X-direction is equal to a pitch between two of the second structures 211*b* with respect to the X-direction. In addition, with respect to the X-direction, a distance between the matching capacitor Cimp and a left end of the first structure 211*a* is smaller than a distance between the matching capacitor Cimp and a right end of the first structure 211*a*.

In some embodiments, a width of the matching capacitor Cimp with respect to the Y-direction is equal to a width of the first structure 211*a* with respect to the Y-direction.

FIG. 2B is a structure schematic diagram of the second surface pcb2 of the printed circuit board pcb of loop antenna 200 in a top view, in accordance with part of structure in FIG. 1, wherein the platform shown in FIG. 2B is indicated as a X-Y plane. FIG. 2B is a plane opposite to the FIG. 2A with respect to the Z-direction, that is, FIG. 2B is an opposite side of FIG. 2A. Therefore, FIG. 2B is similar to FIG. 2A, the same content is not discussed herein and only the difference is discussed.

As illustrated in FIG. 2B, the second antenna structure 220 is disposed inside the clear region CLR, and the second antenna structure 220 is disposed on the second surface pcb2. The second antenna structure 220 includes a radiative metal sheet 221 which is integrally formed. The radiative metal sheet 221 is similar to the first structure 211*a*, and is shaped as a long strap sheet extending along the X-direction, and the radiative metal sheet 221 is parallel to the first structure 211*a* with respect to the Z-direction. One end of the radiative metal sheet 221 is coupled to the ground region GND of the printed circuit board pcb, and where the second structures 211*b* coupled to the ground region GND is indicated as a second ground end (not shown), for grounding the signal.

It should be noted that, with respect to the Z-direction, the projection of the radiative metal sheet 221 onto the first surface pcb1 of the printed circuit board pcb is overlapped with the first structure 211*a* and the matching capacitor Cimp. Alternatively stated, with respect to the Z-direction, the radiative metal sheet 221 is separated from the first structure 211*a*, and the radiative metal sheet 221 and the first structure 211*a* are disposed in parallel and aligned to each other. As such, the signal feed from the first structure 211*a* is able to be coupled to the radiative metal sheet 221 completely.

A length of the radiative metal sheet 221 with respect to the X-direction is smaller than or is equal to one-sixteenth wavelength of the working frequency of the wireless transmission signal. Take the Bluetooth with 2.4 GHz of working frequency for example, a length of the radiative metal sheet 221 with respect to the X-direction may be in a range lower than the one-sixteenth wavelength of the working frequency of the wireless transmission signal (which is about 7.8 mm), to decrease the size of the whole loop antenna 200 accordingly.

In some embodiments, a length of the radiative metal sheet 221 (with respect to the X-direction) is longer than a length of the first structure 211*a* (with respect to the X-direction).

The second antenna structure 220 further includes a resonant capacitor Cres. The resonant capacitor Cres is disposed at an end of the second antenna structure 220, and is coupled to the ground region GND of the printed circuit board pcb, i.e., the other end of the resonant capacitor Cres physically contacts with the printed circuit board pcb. To understand in another way, one end of the resonant capacitor Cres is coupled to the radiative metal sheet 221, and the other end of the resonant capacitor Cres is coupled to the ground region GND.

In some embodiments, a width of the resonant capacitor Cres with respect to the Y-direction is equal to a width of the radiative metal sheet 221 with respect to the Y-direction.

As such, due to one end of the resonant capacitor Cres being grounded, a length of the radiative metal sheet 221 (with respect to the X-direction) may be reduced, and the size of the whole loop antenna 200 may further be shrunk.

In addition, with respect to the Z-direction, due to both of the resonant capacitor Cres and the radiative metal sheet 221 being disposed apart and aligned with both of the first structure 211*a* and the matching capacitor Cimp, the signal, in the operation of coupling between the first antenna structure 210 and the second antenna structure 220, is transmitted in the greatest energy form, and a good coupling performance is provided since then.

To conclude, in the embodiments of the loop antenna 200 with various sizes of components, the loop antenna 200 is able to be arranged in a miniaturized configuration with the limited the clear region CLR, in order to decrease the size of the electronic device 100 (shown in FIG. 1) applied with the loop antenna 200.

Figure 3:
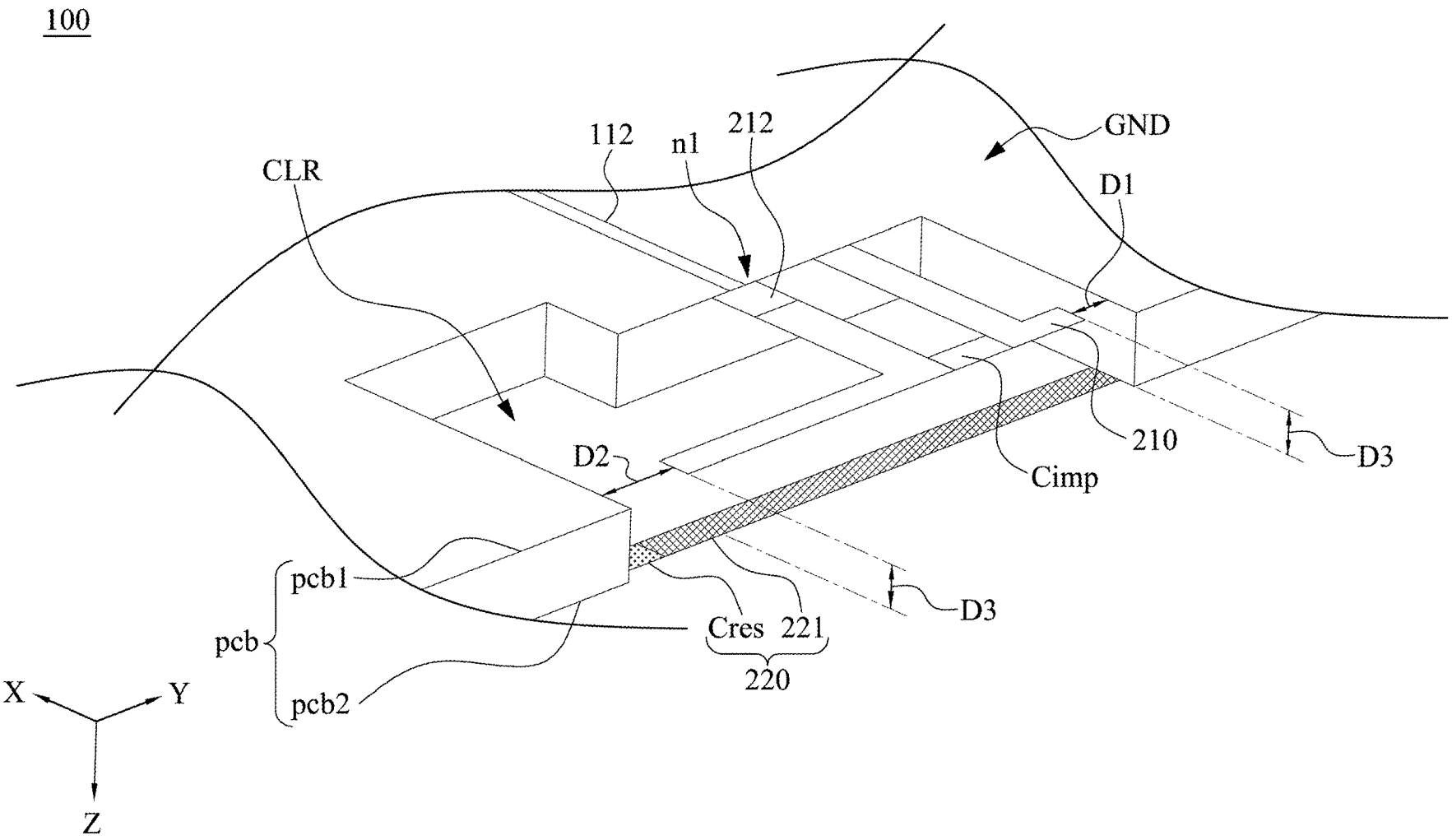
FIG. 3 is a structure schematic diagram of a printed circuit board of a loop antenna, in accordance with FIG. 1.

Also with reference to FIG. 3, FIG. 3 is a 3D schematic diagram of the electronic device 100 in another perspective view, in accordance with FIG. 1. For simplicity of FIG. 3, part of the same elements in FIG. 3 are not numbered or illustrated repeatedly with reference to FIGS. 1, 2A and 2B.

As illustrated in FIG. 3, the first antenna structure 210 and the second antenna structure 220 are disposed separated with respect to Z-direction, and are distanced by a height D3.

In some embodiments, the height D3 is equal to a thickness of the printed circuit board pcb. In some embodiments, the height D3 is smaller than the thickness of the printed circuit board pcb. In some embodiments, the height D3 is in a range of about 0.5 mm to 1.5 mm, and in some examples, the height D3 is about 0.6 mm.

When the electronic device 100 operates the wireless communication functions, a processor (not shown) of the electronic device 100 couples the signal from the loop antenna IC 111 (which is shown in FIG. 1) to the power feed end n1. The signal is coupled from the feed point 212 of the second structure 211*b* (which is shown in FIG. 2A) to the first structure 211*a* (which is shown in FIG. 2A), wherein a impedance of the whole loop antenna 200 is adjusted by the matching capacitor Cimp of the first structure 211*a*, in order to coupling the signal in the greatest energy form to the radiative metal sheet 221.

Then, a resonant frequency of the signal is adjusted by the resonant capacitor Cres of the radiative metal sheet 221, in order to coupling the signal with a specific frequency and transmitting the signal to a specific receiver.

Figure 4:
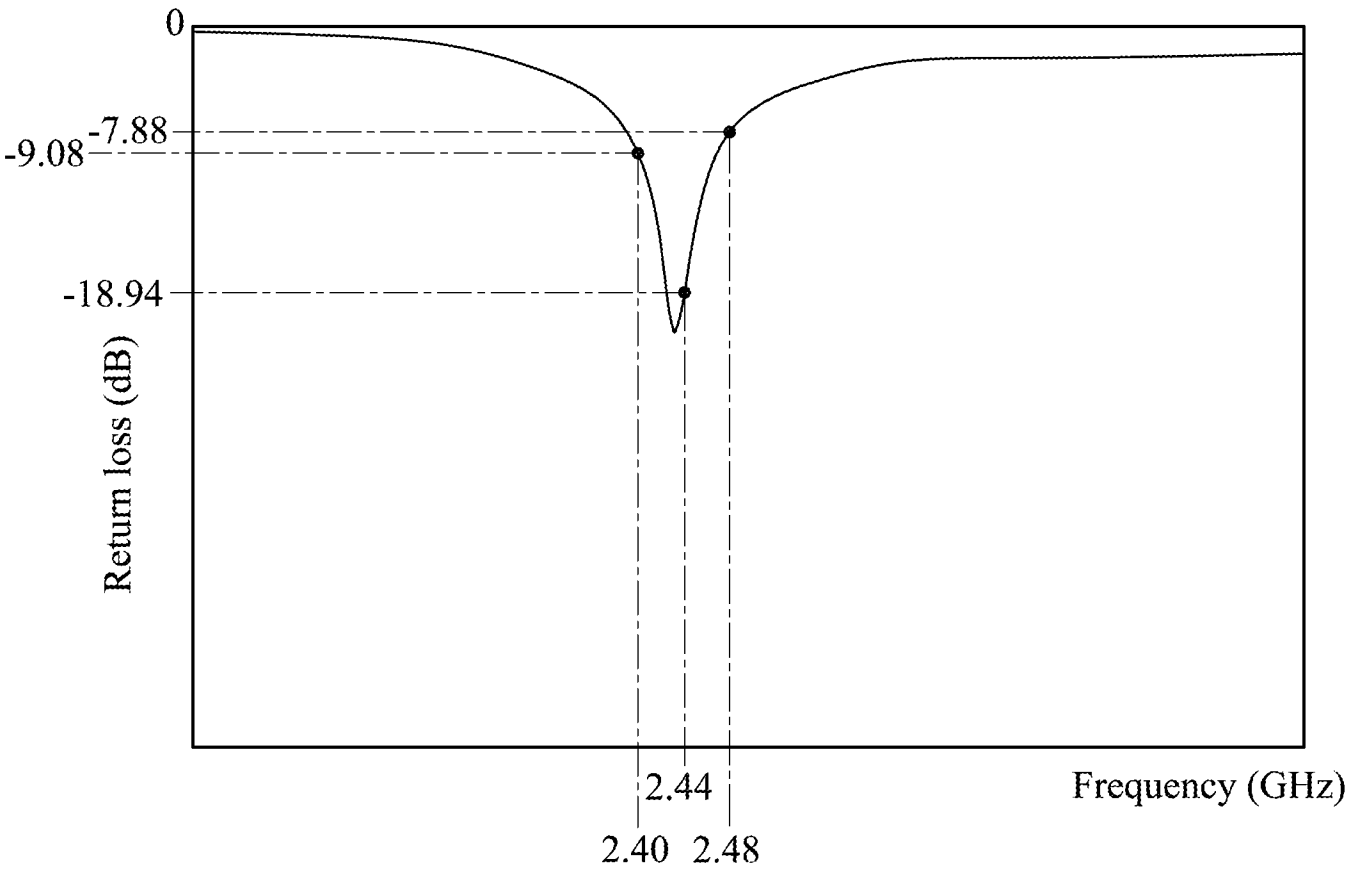
FIG. 4 is a return loss diagram of a printed circuit board of a loop antenna, in accordance with FIG. 1.

FIG. 4 is a return loss diagram of a loop antenna, in accordance with FIGS. 1, 2A, 2B and 3. With reference to FIG. 4, the component sizes of the loop antenna and the distances relative to the printed circuit board are based on the embodiments that are described above, and the loop antenna is applied in the working frequency bandwidth of Bluetooth.

As illustrated in FIG. 4, a frequency bandwidth of the loop antenna covers 2.4 GHz to 2.48 GHz, and all losses corresponding to such working frequency bandwidth are lower than −7 dB. Furthermore, to calculate an efficiency of the loop antenna based on the FIG. 4, the result of the calculation is shown in a Table 1 below, which is an approximation of the loop antenna efficiency that is applied with the working frequency bandwidth.

TABLE 1

| | 2.40 GHz | 2.42 GHz | 2.44 GHz | 2.45 GHz | 2.48 GHz |
|---|---|---|---|---|---|
| antenna efficiency (dB) | −2.61 | −2.39 | −2.42 | −2.51 | −2.48 |
| antenna efficiency (%) | 54.86 | 57.65 | 57.33 | 56.15 | 56.45 |

As illustrated in FIG. 4 and Table 1, the working frequency bandwidth in a range of 2.4 GHz to 2.48 GHz, the antenna efficiency is about in a range of 54.86% to 57.65%, which reaches the requirement of the Bluetooth application in practical. Therefore, the loop antenna of the embodiments of the present disclosure may be implemented with limited miniaturized space.

As mentioned above, the matching capacitor Cimp is able to adjust the impedance matching of the whole loop antenna 200, for example, adjusting the return loss being lower than −7 dB. The resonant capacitor Cres is able to adjust the coupling frequency to the target frequency, such as the working frequency of the Bluetooth. Therefore, for a developer or a producer of wireless communication component, different parameters of signal coupling are able to be adjusted by the matching capacitor Cimp and the resonant capacitor Cres respectively, that is, a signal matching parameter and a resonant parameter of the signal are separated as two independent parameters correspondingly. As a result, the developer or the producer is able to test the signal matching parameter and the resonant parameter independently, for increasing the efficiency of development or production.

To conclude, the loop antenna of the present disclosure is able to implement the wireless communication function arranged in the miniaturized electronic device, by the first antenna structure being separated and aligned with the second antenna structure in the space. With the configuration of both of the matching capacitor and the first structure being relative to both of the resonant capacitor and the radiative metal sheet, the signal coupling between the first structure and the radiative metal sheet provides a good coupling efficiency.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A loop antenna, comprising:

A printed circuit board comprising a first surface and a second surface relative to the first surface, and comprising a clear region and a ground region, wherein the clear region is adjacent to the ground region;

a first antenna structure disposed in the clear region and disposed at the first surface, wherein the first antenna structure comprises a feed structure and a first ground end, the feed structure is coupled to a power feed end disposed in the ground region, and the first ground end is coupled to the ground region; and a second antenna structure disposed relative to the first antenna structure and disposed at the second surface, wherein the second antenna structure comprises a second ground end, and the second ground end is coupled to the ground region.

2. The loop antenna of claim 1, wherein the feed structure comprises:

a matching capacitor; and a feed metal sheet, wherein one end of the feed metal sheet is a feed end, and the other end of the feed metal sheet is coupled to the matching capacitor, wherein the feed end is coupled to the power feed end.

3. The loop antenna of claim 1, wherein the second antenna structure comprises:

a resonant capacitor; and a radiative metal sheet, wherein one end of the radiative metal sheet is the second ground end, and the other end of the radiative metal sheet is coupled to the resonant capacitor.

4. The loop antenna of claim 3, wherein one end of the resonant capacitor is coupled to the radiative metal sheet, and the other end of the resonant capacitor is coupled to the ground region.

5. The loop antenna of claim 3, wherein a length of the radiative metal sheet is smaller than or is equal to one-sixteenth wavelength of a working frequency of a transmission signal of the loop antenna.

6. The loop antenna of claim 2, wherein the feed metal sheet comprises a first structure and at least one second structure, and the first structure extends along a first direction, the at least one second structure extends along a second direction, and one end of the at least one second structure is coupled to the first structure and extends from the first structure, and the other end of the at least one second structure is coupled to the ground region.

7. The loop antenna of claim 6, wherein the at least one second structure comprises two second structures, wherein the one of the second structures is the first ground end, and the other one of the second structures is coupled to the power feed end.

8. The loop antenna of claim 6, wherein the second antenna structure is disposed extending along the first direction.

9. The loop antenna of claim 8, wherein a projection of the first structure and the matching capacitor onto the second surface are overlapped with the second antenna structure.

10. The loop antenna of claim 6, wherein two ends of the first structure are separated from the ground region by a first interval and a second interval, respectively.

11. The loop antenna of claim 1, wherein the first antenna structure is separated from the second antenna structure by a third interval, and the third interval, is about in a range of 0.5 mm to 1.5 mm.

* * * * *